US010363527B2

(12) United States Patent
Johnson et al.

(10) Patent No.: US 10,363,527 B2
(45) Date of Patent: Jul. 30, 2019

(54) MIXING CONTAINER

(71) Applicant: Munchkin, Inc., Van Nuys, CA (US)

(72) Inventors: Kevin Douglas Johnson, Tarzana, CA (US); Matthew Saxton, Agoura, CA (US); Katlyn Morris, Toledo, OH (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/723,131

(22) Filed: Oct. 2, 2017

(65) Prior Publication Data

US 2018/0093236 A1 Apr. 5, 2018

Related U.S. Application Data

(60) Provisional application No. 62/402,904, filed on Sep. 30, 2016.

(51) Int. Cl.

| | |
|---|---|
| ***B01F 7/16*** | (2006.01) |
| ***B01F 3/12*** | (2006.01) |
| ***B01F 7/00*** | (2006.01) |
| ***B01F 7/22*** | (2006.01) |
| ***B01F 15/00*** | (2006.01) |
| ***B65D 25/28*** | (2006.01) |
| ***B65D 47/06*** | (2006.01) |
| ***B65D 47/32*** | (2006.01) |
| ***B65D 51/24*** | (2006.01) |

(Continued)

(52) U.S. Cl.

CPC ..... *B01F 7/161* (2013.01); *B01F 3/1221* (2013.01); *B01F 7/00341* (2013.01); *B01F 7/22* (2013.01); *B01F 11/0054* (2013.01); *B01F 13/0022* (2013.01); *B01F 15/00506* (2013.01); *B01F 15/00512* (2013.01); *B65D 25/282* (2013.01); *B65D 47/06* (2013.01); *B65D 47/261* (2013.01); *B65D 47/32* (2013.01); *B65D 51/242* (2013.01); *B65D 51/32* (2013.01); *B65D 53/02* (2013.01); *B01F 2215/0022* (2013.01)

(58) Field of Classification Search

CPC ..... B01F 11/0054; B01F 13/0022; B01F 15/00506; B01F 15/00512; B01F 2215/0022; B01F 3/1221; B01F 7/161; B01F 7/22; B01F 7/00341; B65D 25/282; B65D 47/06; B65D 47/261; B65D 47/32; B65D 51/242; B65D 51/32; B65D 53/02

See application file for complete search history.

(56) References Cited

U.S. PATENT DOCUMENTS 1,193,954 A * 8/1916 Walden ..... B01F 13/002 220/253
1,344,836 A * 6/1920 Walden ..... A47J 36/165 366/130

(Continued)

FOREIGN PATENT DOCUMENTS

GB 1334465 10/2017

OTHER PUBLICATIONS

International Search Report and Written Opinion for PCT/US2017/054800, dated Dec. 15, 2017. (pp. 11).

(Continued)

*Primary Examiner* — Tony G Soohoo
(74) *Attorney, Agent, or Firm* — Robert Z. Evora, Esq.

(57) ABSTRACT

A mixing container is disclosed having a moving grip positioned outside of its lid such that the grip is rotatable to allow contents inside the container to pour out or to prevent the pouring of contents.

18 Claims, 10 Drawing Sheets

(51) Int. Cl.

| | |
|---|---|
| ***B65D 51/32*** | (2006.01) |
| ***B65D 53/02*** | (2006.01) |
| ***B01F 11/00*** | (2006.01) |
| ***B01F 13/00*** | (2006.01) |
| ***B65D 47/26*** | (2006.01) |

(56) References Cited

U.S. PATENT DOCUMENTS 1,405,442 A * 2/1922 Ritz ..... B27G 11/02 220/212
1,707,968 A * 4/1929 Kieselbach ..... B01F 7/1695 366/333
2,485,303 A * 10/1949 Marcus ..... B01F 7/00333 141/112
3,417,972 A * 12/1968 Conway ..... A47J 43/046 241/199.12
4,655,373 A 4/1987 Essen
4,946,286 A * 8/1990 Purkapile ..... B01F 11/0054 366/243
5,029,719 A * 7/1991 Solomon ..... A47G 19/2266 215/229
5,549,381 A * 8/1996 Hays ..... B01F 7/0005 366/139
5,894,952 A * 4/1999 Mendenhall ..... A47G 19/2272 215/230
6,086,240 A * 7/2000 Murphy ..... A47G 19/22 366/147
6,224,253 B1 * 5/2001 Dixon ..... A47J 43/27 366/247
6,324,966 B1 12/2001 Joergensen
6,638,131 B1 * 10/2003 Thai ..... A63H 33/28 446/15
6,857,928 B2 * 2/2005 Thai ..... A63H 33/28 446/15
8,534,908 B2 * 9/2013 Rhodes, II ..... A47J 43/1018 222/465.1
8,936,387 B2 * 1/2015 Venot ..... B01F 7/0055 366/129
9,107,541 B2 8/2015 Bodum
2004/0090861 A1 * 5/2004 Kitson ..... A47G 19/12 366/244
2005/0218141 A1 * 10/2005 Kratzer ..... A47G 19/186 220/212
2007/0131691 A1 6/2007 Evans
2010/0308046 A1 * 12/2010 Serra ..... A47G 19/2205 220/212
2017/0274332 A1 * 9/2017 Gandhi ..... B01F 7/00141
2018/0093236 A1 * 4/2018 Johnson ..... B01F 3/1221
2018/0111728 A1 * 4/2018 Eisen ..... B65D 39/08

OTHER PUBLICATIONS

Search History for PCT/US2017/054800, dated Nov. 21, 2017. (pp. 4).

* cited by examiner

MIXING CONTAINER

CROSS REFERENCE TO RELATED APPLICATIONS

This application claims priority to U.S. Provisional Patent Application Ser. No. 62/402,904, filed Sep. 30, 2016; the content of which is hereby incorporated by reference herein in its entirety into this disclosure.

TECHNICAL FIELD

The subject disclosure relates to a container for mixing ingredients and particularly to a multi-position mixing container.

BACKGROUND

Containers and pitchers with mixing devices typically include a container, a lid, an integrated mixing device, and a handle for the mixing device to agitate the mixing device up and down or side to side.

However, a disadvantage with these conventional containers is that liquid solution stored inside the container is prone to bacteria and other airborne contaminants. This is a common concern for parents who use these types of mixing containers for milk and other baby formula. As a result, parents are discouraged from storing various milk solutions in these containers for an extended period. Parents must create new milk solutions before each feeding while under pressure from a crying hungry baby. This problem is further compounded at night when parents are abruptly wakened and struggle with having to make a new batch of milk solution.

Thus, there is a need for a mixing container which is easy to use, effective at mixing, easy to clean, and has an airtight seal to extend storage of pre-prepared milk solution.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

Several exemplary embodiments of the subject disclosure provide for a mixing container assembly. The mixing container assembly has at least two positions. In a first or closed position, a spout plug, shaft plug, and a ventilation plug (e.g., cork) create an airtight seal between a lid and a mixing handle. In a second or open position, the shaft plug rotates at or about 90 degrees from the first or closed position, and secures onto the lid by friction fit to allow contents (e.g., liquid) to pour out from a spout located on the lid.

While various aspects, features, or advantages of the subject disclosure are illustrated in reference to mixing containers, such aspects and features also can be exploited in various other container configurations.

To the accomplishment of the foregoing and related ends, the subject disclosure, then, comprises the features hereinafter fully described. The following description and the annexed drawings set forth in detail certain illustrative aspects of one or more embodiments of the disclosure.

However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
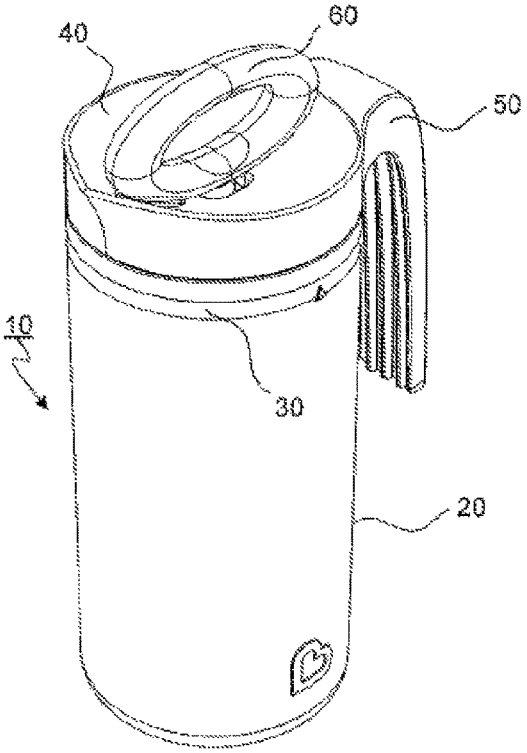
FIG. 1 illustrates an exemplary two-position mixing container in the closed position, according to an exemplary embodiment of the present subject disclosure.

Particular embodiments of the present subject disclosure will now be described in greater detail with reference to the figures.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

Two exemplary embodiments of the present subject disclosure are presented herein. One exemplary embodiment is presented in FIGS. 1-8, and another exemplary embodiment is presented in FIGS. 9-17. For sake of comparability, similar numerical labels are presented for each of the embodiments with the first embodiment having a two digit numeral label for each component, and the second embodiment having the same two digit numeral label which corresponds to the same or similar component shown in the first embodiment, but preceded with a "1" to make it a three digit label. Although each embodiment is shown with the similar or different features, it is to be understood that the unique aspects of one embodiment may be substituted into the same position in the other embodiment. In other words, the particular combination of unique features of one embodiment is not limited to that described, but such unique features may be mixed and matched between the embodiments, as desired, and still be within the scope of the present subject disclosure.

Figure 2:
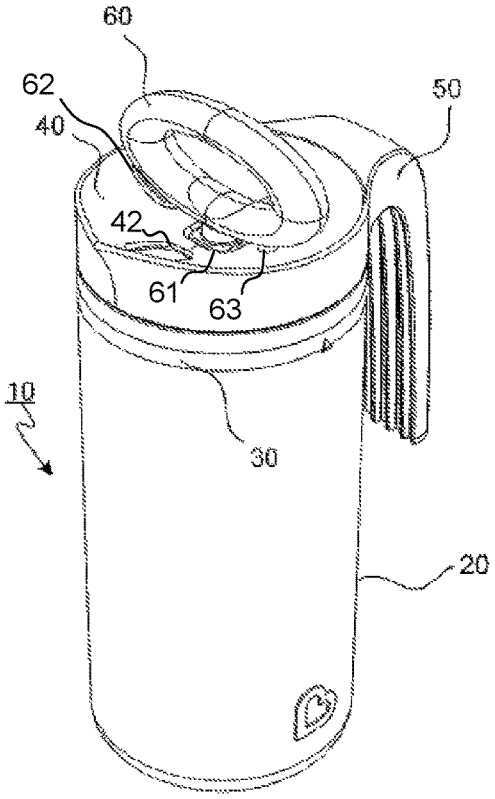
FIG. 2 is a perspective view of the two-position mixing container in an open position, according to an exemplary embodiment of the present subject disclosure.

FIGS. 1-8 illustrate a first exemplary embodiment of a multi-position mixing container 10 for liquid mixing and storage, according to the present subject disclosure. FIG. 1 shows the two-position mixing container 10 in the first or closed position and FIG. 2 shows the two-position mixing container 10 in the second or open position. The two-position mixing container 10 generally includes a container 20 for storing fluids, a lid 40, which may have an integrated (or separable) handle 50, mixing grip 60 and a mixer 67.

As shown in FIGS. 1-8, the container 20 is generally cylindrical in shape having a closed or bottom end and an open top end connected by a cylindrical wall. The bottom end, open end, and cylindrical wall collectively form an inner cavity with an exterior surface. The inner cavity receives and stores both contents (e.g., aqueous fluids) and the mixing unit 67 contiguously.

An indicator ring 30 has a series of markings 32 which are inscribed onto the indicator ring's outer surface. The indicator ring 30 provides a visual display of an emphasized mark. In the illustrated configuration, the markings 32 depict hourly time intervals but it is understood that the markings 32 can be any pictorial or alphanumeric mark. The indicator ring 30 is adapted to fit around a neck located on the container 20 adjacent to the open end. The indicator ring 30 releasably rotates around the container 20 and has a locking mechanism to position the indicator ring 30 into place. The indicator ring 30 swivels independently and does not affect or alter the position of the lid 40. The indicator ring 30 may be used to, for example, record a time that a mixture was made inside the container 20. Since many baby formulas have a limited shelf life once the powder is combined with water, the indicator ring 30 is a helpful way to lock in a time of creation of the formula. Thus, a parent can then determine at a later time if the formula may still be safe to use for an infant or whether it should be discarded. The markings 32 may be hours, days, or other convenient time unit.

The lid 40 includes a recess 41, a pour aperture 42, a ventilation aperture 43, and a spout 48. A handle 50 may be attached to the lid 40 or may be detachably connected to the lid 40. The lid 40 is generally circular with a concave top surface. The handle 50 extends radially downwards from the top surface of the lid 40 to a distal end. As illustrated in FIGS. 1-8, the handle 50 extends about more than half past the length of the container 20. However, the handle 50 may be any length and the distal end may connect to the cylindrical wall of the container 20 (not shown). The handle 50 is preferably integrated with the lid 40 and may be made with food grade plastic, or the like.

A spout 48 is formed on the top surface of the lid 40, opposite the handle 50. The spout 48 is positioned adjacent to the pour aperture 42 to direct the outward flow of fluid from the inside of the container 20, through the pour aperture 42, and outward via the spout 48. The pour aperture 42 is adapted to receive a spout plug 62 which is positioned on the underside of the mixing grip 60. When the two-position mixing container 10 is in a first or closed position, the pour aperture 42 friction fits with the spout plug 62 to create an airtight seal, as illustrated in FIG. 1. The pour aperture 42 and spout plug 62 are generally oblong in shape but it is understood that they may take on different shapes or sizes, as long as they have complementary shapes. The ventilation aperture 43 acts as an air valve and assists in the flow of fluid out of the container 20 when the grip 60 is in the open position (FIG. 2).

The mixing unit generally comprises the grip 60, the shaft plug 61, the shaft 64, and the shaft receiver 66 on a mixer 67 which is directly connected to the shaft 64. The grip 60 is preferably circular or O-shaped and generally has an open portion and a connecting portion. The open portion is wide enough to allow at least two fingers to pass comfortably through allowing one to firmly move the mixer 67 up and down inside the container 20. The connection portion includes the spout plug 62, the ventilation plug 63, and the shaft plug 61 positioned in between the spout plug 62 and the ventilation plug 63. The spout plug 62 is adapted to fit through the pour aperture 42 located on the lid 40. Similarly, the ventilation plug 63 also adapts to the ventilation aperture 43.

Figure 3:
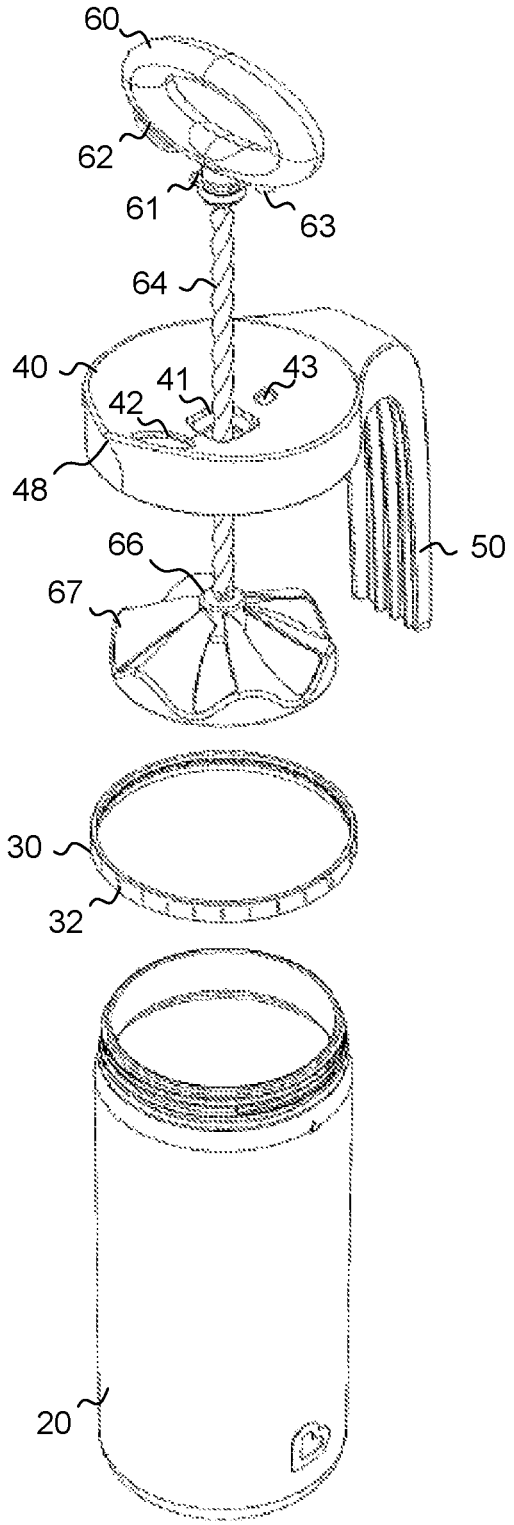
FIG. 3 is an exploded view of the two-position mixing container, according to an exemplary embodiment of the present subject disclosure.
Figure 8:
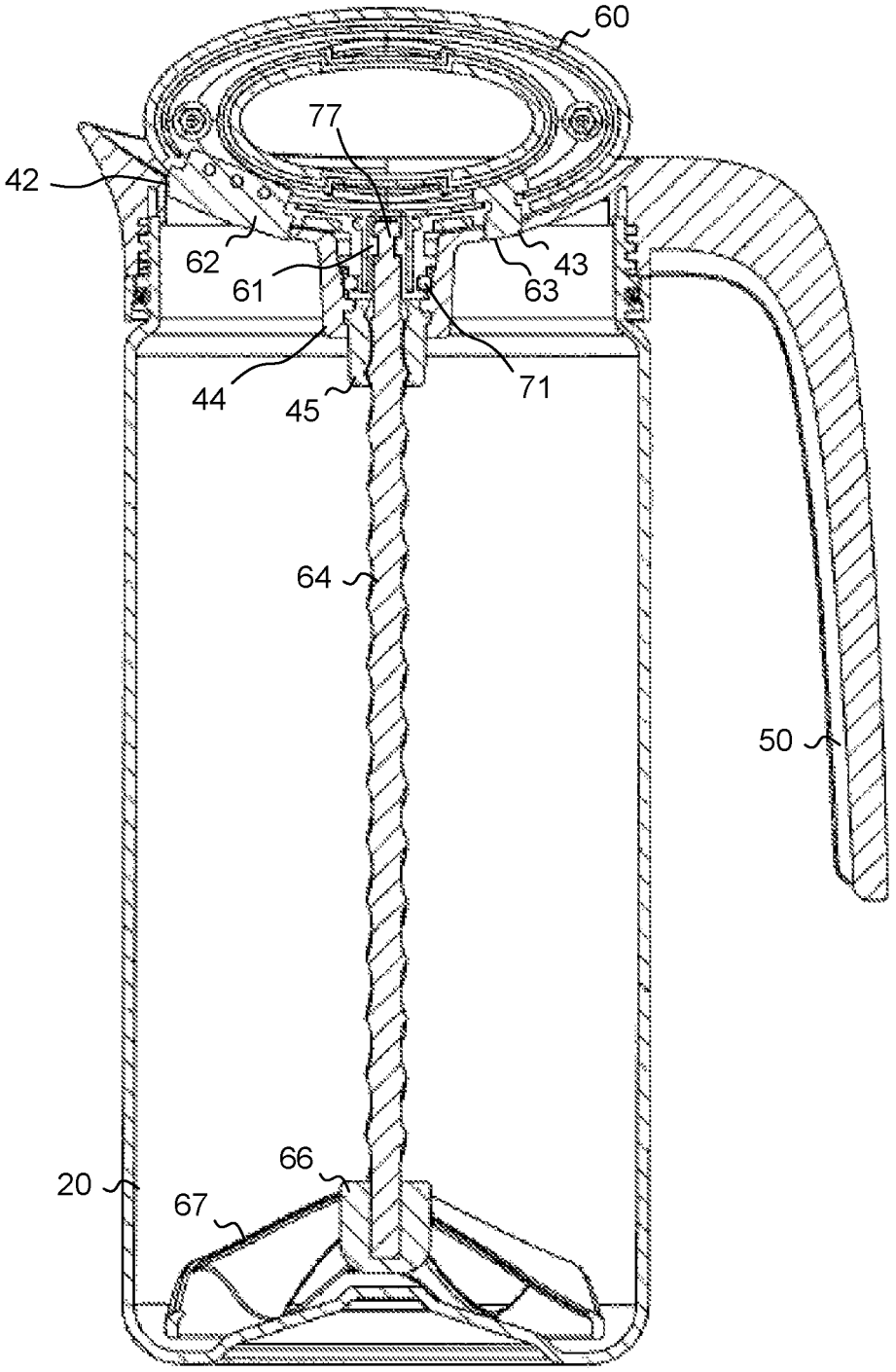
FIG. 8 illustrates a section view taken at the plane A-A of FIG. 4, according to an exemplary embodiment of the present subject disclosure.

FIGS. 3 and 8 show some detail of the inner mechanism of the mixing container 10. It should be noted that, as shown in FIG. 8, the spout plug 62 and the ventilation plug 63 are independent pieces and are added pieces to the two identical halves that comprise the grip 60. Further, the grip 60 is connected with the shaft 64 through a connection 77 which involves a snap in of corresponding sharp edged ends of the shaft 64. The surface of the lid 40 includes a recess 41 which is sized to fit the shaft plug 61 perfectly. In an exemplary embodiment, the shaft plug 61 is square and fits into a square shaped recess 41. Thus, the shaft plug 61 may be fit into the recess 41 in four different positions. A receiving housing 44 in the lid 40 accommodates the shaft plug 61 of the grip 60. Shaft plug 61 includes an O-ring 71 which provides an air tight friction fit within the receiving housing 44. Further, a bushing 45 in the lid serves to further grip the shaft 64 and provide further structure and stability to the shaft 64 during use. The shaft 64 extends into a shaft receiver 66 positioned central on the mixer 67. The shaft 64 may be permanently bonded to the shaft receiver 66. The mixer 67 may be an impeller or other device which causes efficient mixing within the container 20 when the grip 60 is pulled up and pushed down into the container 20.

Figure 9:
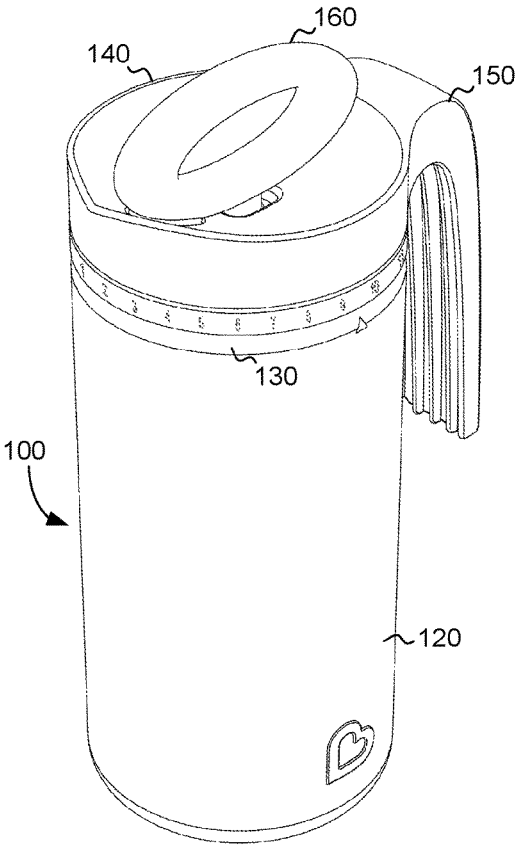
FIG. 9 illustrates an exemplary two-position mixing container in the closed position, according to another exemplary embodiment of the present subject disclosure.
Figure 10:
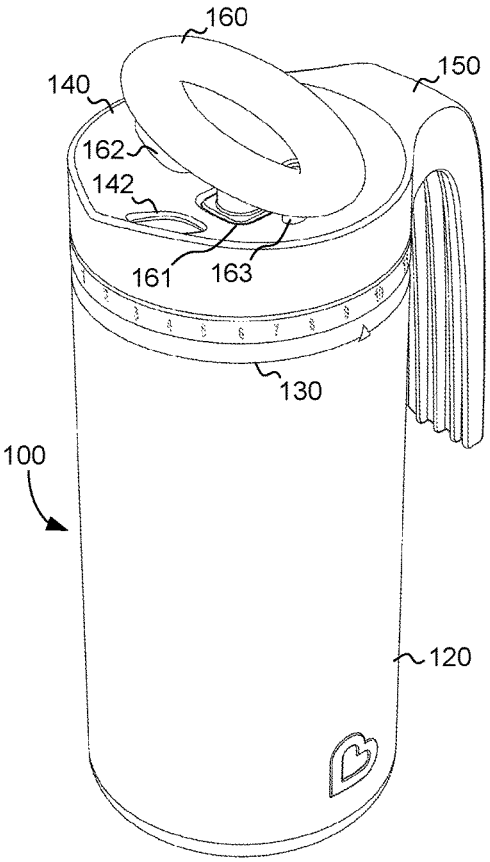
FIG. 10 is a perspective view of the two-position mixing container in an open position, according to another exemplary embodiment of the present subject disclosure.

Another exemplary embodiment of the present subject disclosure is presented in FIGS. 9-17. As illustrated in the figures, a mixing container 100 includes a container 120, an indicator 130, a lid 140, a handle 150, and a grip 160. FIG. 9 shows the mixing container 100 in the closed position, in that no contents may be poured out from the container 120. FIG. 10 shows the rotation of grip 160 in a 90 degree clockwise direction (as compared to FIG. 9) which allows the opening of the pour aperture 142. The grip 160 may be pulled upward (away from the container 120) and rotated at will, and repositioned onto the lid 140 in one of four positions because the shaft plug 161 is in a shape of a square and the recess 141 is also in the shape of a square so the recess 141 can accommodate the shaft plug 161 in one of four positions. As shown in FIG. 10, the shaft plug 161 may be positioned within recess 141 which disengages the spout plug 162 from the pour aperture 142, and the disengages the ventilation plug 163 from the ventilation aperture 43.

Figure 4:
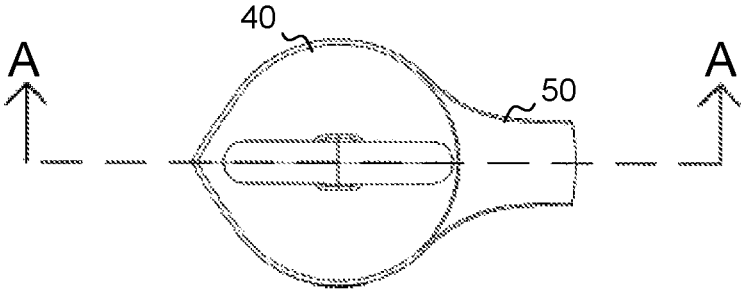
FIG. 4 is a top view of the two-position mixing container in the closed position, according to an exemplary embodiment of the present subject disclosure.
Figure 5:
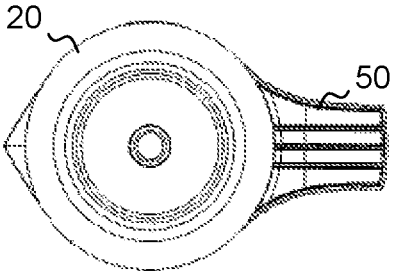
FIG. 5 is a bottom view of the two-position mixing container, according to an exemplary embodiment of the present subject disclosure.
Figure 6:
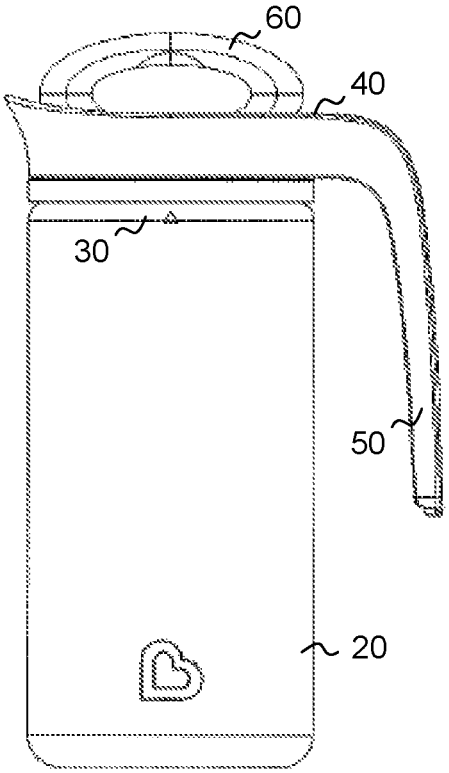
FIG. 6 is a right side view of the two-position mixing container in the closed position according to an exemplary embodiment of the present subject disclosure.
Figure 7:
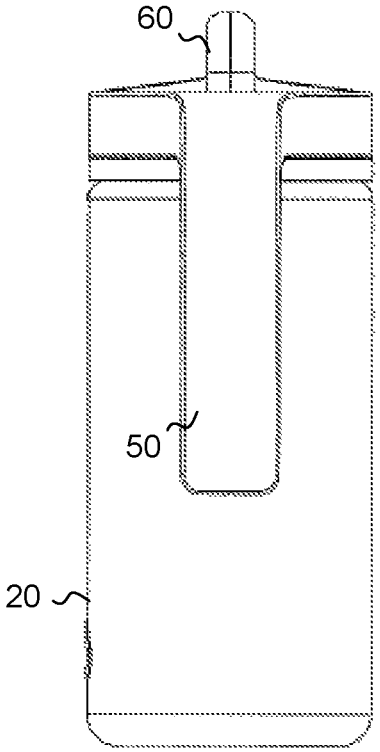
FIG. 7 is a back view of the two-position mixing container in the closed position, according to an exemplary embodiment of the present subject disclosure.
Figure 12:
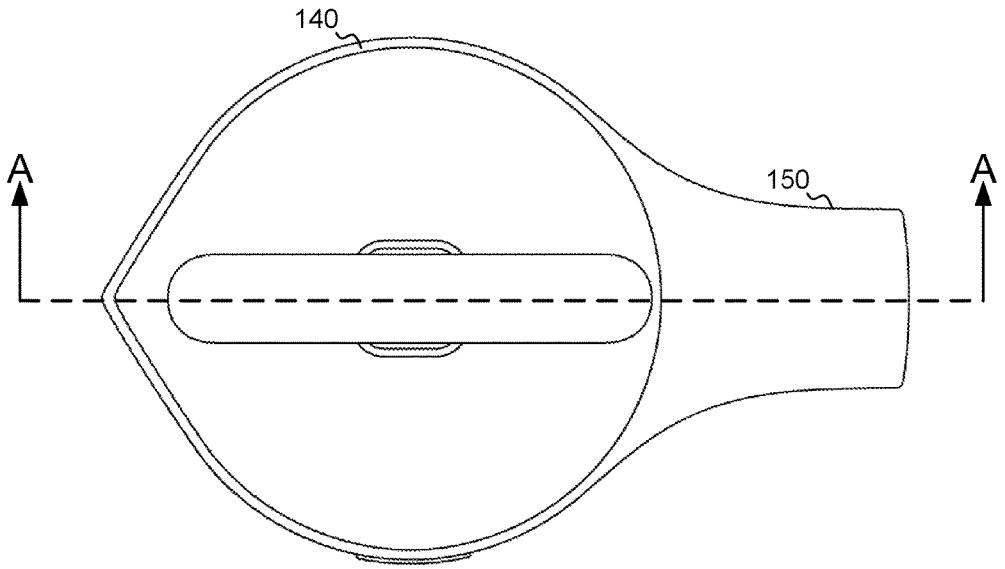
FIG. 12 is a top view of the two-position mixing container in the closed position, according to another exemplary embodiment of the present subject disclosure.
Figure 13:
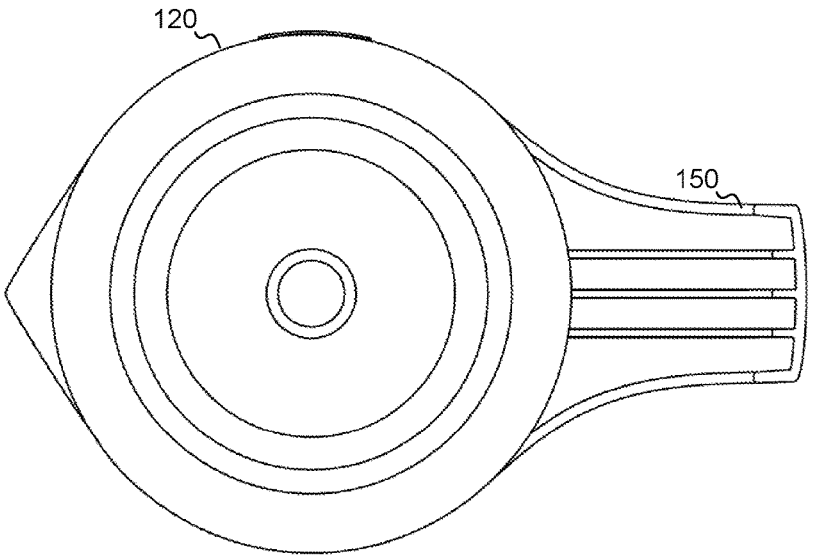
FIG. 13 is a bottom view of the two-position mixing container, according to another exemplary embodiment of the present subject disclosure.
Figure 14:
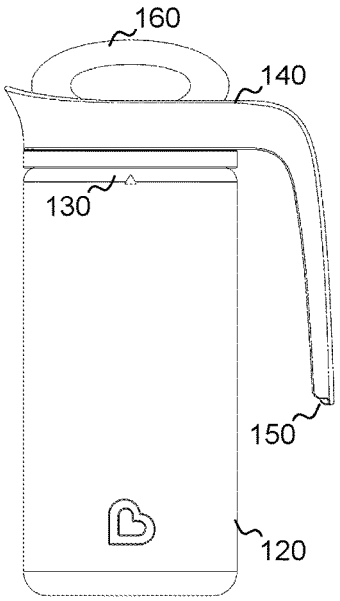
FIG. 14 is a right side view of the two-position mixing container in the closed position, according to another exemplary embodiment of the present subject disclosure.
Figure 15:
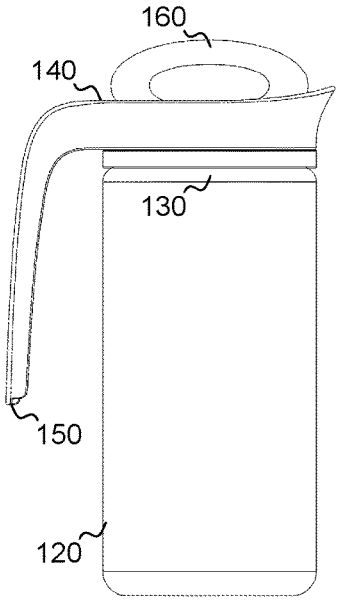
FIG. 15 is a left side view of the two-position mixing container in the closed position, according to another exemplary embodiment of the present subject disclosure.
Figure 16:
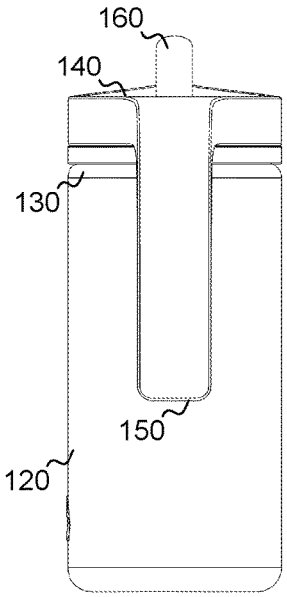
FIG. 16 is a back view of the two-position mixing container in the closed position, according to another exemplary embodiment of the present subject disclosure.

FIGS. 12-13 are substantially similar to FIGS. 4-5. Further, FIGS. 14-16 are substantially similar to FIGS. 6-7. These corresponding figures have been presented for sake of completeness, but do not show the variations in the two embodiments.

Figure 11:
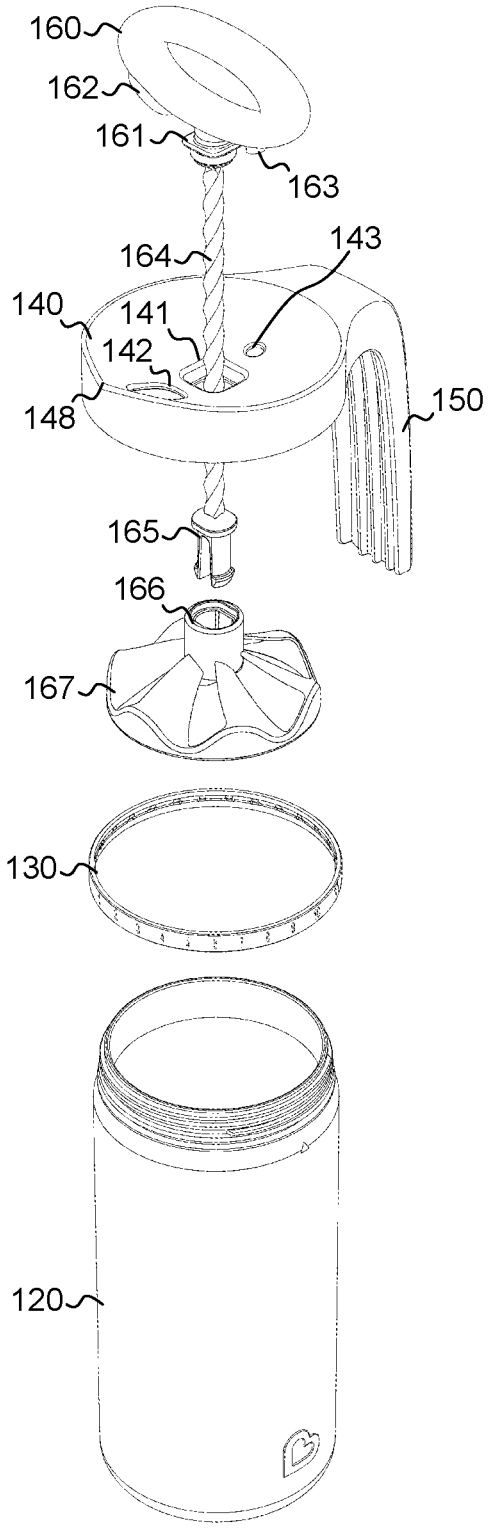
FIG. 11 is an exploded view of the two-position mixing container, according to another exemplary embodiment of the present subject disclosure.
Figure 17:
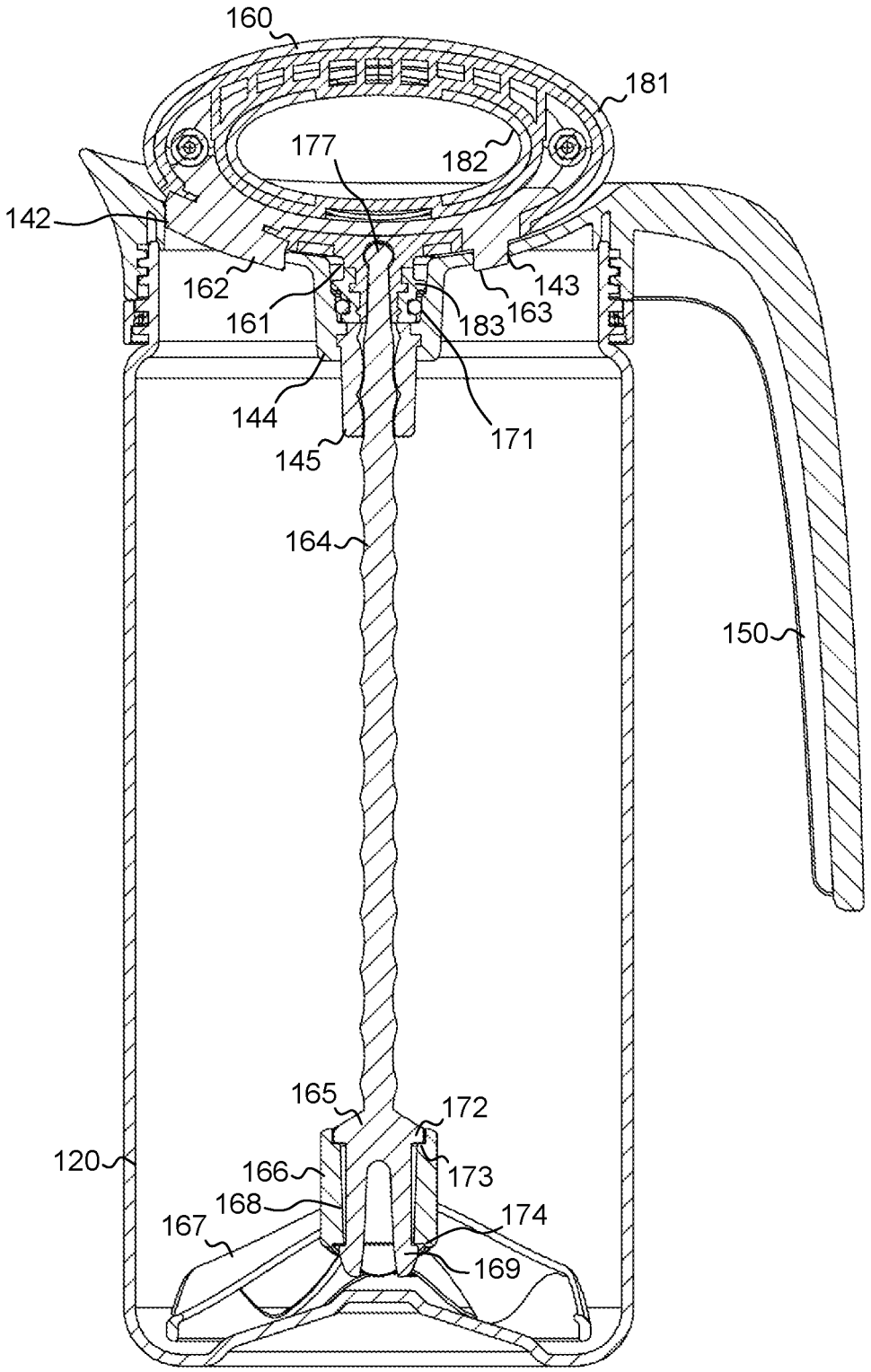
FIG. 17 illustrates a section view taken at the plane A-A of FIG. 12, according to another exemplary embodiment of the present subject disclosure.

The distinctions between the exemplary embodiments described in this subject disclosure are evident in FIGS. 11 and 17. The shaft 164 terminates in an enlarged distal portion 165, which engages an aperture 168 in a vertical receiving member 166 positioned within the center of mixer 167. A shoulder 172 on the shaft 164 engages with a stop wall 173 within the aperture 168 while a flexible forked end 169 of the shaft 164 locks with the catch 174 of the vertical receiving member 166. Such a mechanism allows for the disengagement of the shaft 164/165/169 portion from the mixer 167 for cleaning, replacement, etc.

Another distinction of the second embodiment from the first embodiment relates to the structure of the grip 160 and how it is connected to the shaft 164. As shown in FIG. 17, the grip 160 includes two halves which are connected together. Rubberized overmold 181 and 182 may be used to fortify the "stickiness" of the surface of the grip 160 which will be in contact with fingers of a user. Further, the spout plug 162 and ventilation plug 163 are part of the same unitary structure, as illustrated in the cross section cut of FIG. 17. Having the spout plug 162 and ventilation plug 163 be part of the same unitary structure will increase the efficiency of manufacturing and decrease the number of parts needed to assemble the mixing container 100. If either of the spout plug 162 or ventilation plug 163 is damaged, deteriorated, or needs to be replaced, the grip 160 is simply opened up and a new combination spout plug 162/ventilation plug 163 is inserted. Further, the connection 177 of the grip 160 to the top end of the shaft 164 is spherical and tapered and has no sharp edges (as opposed to the first embodiment, as illustrated in FIG. 8). The spherical configuration and tapered edges of the connection 177 allows for increased durability and strength as opposed to straight edge connections.

The grip 160 in this embodiment comprises two identical halves which are connected together, have a unitary structure which includes a spout plug 162 and ventilation plug 163, an overmold molded retainer 183 with a seal gasket 171. These grip 160 connected components interact with the lid 140 connected components which include a receiving housing 144 and an overmolded bushing 145. The combination of the corresponding structures between the grip 160 and the lid 140 promote an air-tight seal.

The various components described herein, for example, the shafts 64 and 164, may be composed of metal, plastic, composite or any other material which would be suitable for this subject disclosure. Further, the mixing container 10 or 110 is not limited to use to make baby formula but may be for making sports drinks, protein drinks, mixed alcoholic drinks, or any other uses which would benefit from a thorough mixing of contents within a container.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A mixing container, comprising:

a container;

a lid attached to the container having a shaft aperture and a pour aperture; and a grip having a spout plug and a shaft, the shaft extending through the shaft aperture of the lid and into the container, wherein the grip is moveable about the lid from a first closed position in which the spout plug engages with the pour aperture and prevents contents from inside of the container to come out of the container, to a second open position in which the pour aperture allows contents from inside of the container to come out of the container.

2. The mixing container of claim 1, wherein the lid includes a ventilation aperture which is separate from the pour aperture.

3. The mixing container of claim 2, wherein the grip includes a ventilation plug which engages with the ventilation aperture.

4. The mixing container of claim 3, wherein in the first closed position, the ventilation plug is engaged with the ventilation aperture.

5. The mixing container of claim 3, wherein in the second open position, the spout plug is disengaged with the pour aperture, and the ventilation plug is disengaged with the ventilation aperture.

6. The mixing container of claim 1, wherein the grip engages the lid through a friction fit attachment.

7. The mixing container of claim 6, wherein the grip has a shaft plug which is received in the shaft aperture within the lid.

8. The mixing container of claim 7, wherein the shaft plug on the grip is square shaped and the shaft aperture is square shaped, such that the square shaped shaft plug is received within the square shaped shaft aperture within the lid.

9. The mixing container of claim 7, wherein the shaft plug of the grip includes a seal gasket which engages with the shaft aperture to create an air tight seal.

10. The mixing container of claim 1, wherein the grip engages the shaft through an attachment having sharp corners.

11. The mixing container of claim 1, wherein the grip engages the shaft through a friction fit attachment having a spherical shape.

12. The mixing container of claim 1, wherein the shaft is connected to a mixer inside of the container.

13. The mixing container of claim 12, wherein the mixer is an impeller.

14. The mixing container of claim 13, wherein the shaft has a flexible forked end which reversibly engages with the impeller.

15. The mixing container of claim 1, further comprising a handle positioned on the lid.

16. The mixing container of claim 1, further comprising a spout positioned on the lid.

17. The mixing container of claim 16, wherein the spout is positioned adjacent the pour aperture.

18. A mixing container, comprising:

a container;

a lid attached to the container having a shaft aperture and a pour aperture; and a grip connected to a mixer inside the container through a shaft extending through the shaft aperture of the lid and into the container, wherein the grip is moveable about the lid from a first closed position which engages a spout on the grip with a pour aperture on the lid, to a second open position which disengages the spout plug on the grip with the pour aperture on the lid.

* * * * *